US006835285B2

(12) United States Patent
Aho

(10) Patent No.: US 6,835,285 B2
(45) Date of Patent: Dec. 28, 2004

(54) METHOD FOR SETTING THE SHOE POSITION IN AN EXTENDED-NIP PRESS AND EXTENDED-NIP PRESS

(75) Inventor: Erkki Aho, Elimäki (FI)

(73) Assignee: Vaahto Oy, Hollola (FI)

( * ) Notice: Subject to any disclaimer, the term of this patent is extended or adjusted under 35 U.S.C. 154(b) by 129 days.

(21) Appl. No.: 10/185,132

(22) Filed: Jul. 1, 2002

(65) Prior Publication Data

US 2003/0024678 A1 Feb. 6, 2003

(30) Foreign Application Priority Data

Jul. 5, 2001 (FI) ..... 20011470

(51) Int. Cl.[7] ..... D21F 3/00
(52) U.S. Cl. ..... 162/358.3; 492/7; 492/20
(58) Field of Search ..... 162/358.3, 358; 492/7, 20

(56) References Cited

U.S. PATENT DOCUMENTS 4,713,147 A 12/1987 Saarinen
4,917,768 A * 4/1990 Ilmarinen ..... 162/358
4,973,384 A 11/1990 Crouse et al.

FOREIGN PATENT DOCUMENTS

DE 43 44 165 A1 6/1995
DE 196 07 144 A1 8/1997

* cited by examiner

*Primary Examiner*—Peter Chin
(74) *Attorney, Agent, or Firm*—Birch, Stewart, Kolasch & Birch, LLP

(57) ABSTRACT

A method for setting a position of a shoe in an extended-nip press having a press roll and a backing roll, said press roll including a rotating endless-loop blanket of a flexible, liquid-impervious material, a rigid stationary roll support beam extending through an interior of endless blanket, a shoe element with a concave top face mounted above the roll support beam, and a loading element for loading the shoe element by pressing the top face thereof against the endless-loop blanket to make the blanket form a press nip zone in cooperation with the backing roll. The shoe element connects to the loading element by a detachable saddle element mountable between the shoe element and the loading element and by setting the position of the shoe element relative to the loading element through changing a mutual disposition of the saddle element and the shoe element.

14 Claims, 3 Drawing Sheets

METHOD FOR SETTING THE SHOE POSITION IN AN EXTENDED-NIP PRESS AND EXTENDED-NIP PRESS

BACKGROUND OF THE INVENTION

The present invention relates to a method for setting a shoe position in an extended-nip press and an extended-nip press.

Generally an extended-nip press comprises a press roll cooperating with a backing roll. Typically, the press roll comprises a rotating endless-loop blanket of a flexible, liquid-impervious material, a rigid and advantageously stationary roll support beam that extends axially through the interior of the endless blanket and has a stub shaft mounted at its both ends, at least one press shoe resting on the roll support beam and having a concave top face, loading means for pressing the concave top face against the flexible endless blanket so as to form a press nip zone in cooperation with the backing roll, two blanket-clamping roll heads axially movable on their respective stub shafts, clamp elements for engaging the lateral rims of the blanket to the respective roll heads and at least one element for tightening and/or moving the flexible endless blanket in the axial direction of the respective stub shaft.

The shape of the nip pressure profile generated by the press nip zone and imposed on the web passing therethrough is determined by the shape of the concave face of the press shoe and its position relative to the backing roll and the means loading the shoe. Hence, the shape of the nip pressure profile can be adjusted either by controlling the concave shape of the shoe top face or by moving the position of the shoe relative to the backing roll and/or the shoe loading means.

Among other factors, an advantageous shape of the nip pressure profile is dependent on the paper grade being manufactured. For instance, lightweight paper grades are problematic by undergoing rewetting in an extended-nip press, whereby the most advantageous nip pressure profile for these grades is adjusted such that the peak pressure in the machine direction is close to the outgoing side of the press nip zone. Thicker paper grades, thick paperboards in particular, are problematic by undergoing collapse of the web internal structure if the machine direction nip pressure profile rises excessively steeply and the maximum nip pressure is too high. Hence, thick paper grades are generally most advantageously run using a relatively smooth nip pressure profile having the peak pressure adjusted in the machine direction close to the middle of the press nip zone. Typically, a papermaking machine is used for making more than a single paper grade. Accordingly, it is desirable that the pressure profile of an extended-nip press be adjustable as required by the paper grade being manufactured.

For Instance, patent publication FI 65103 teaches the adjustment of the nip pressure profile to take place by way of providing the support means of the press shoe with transfer means adapted to shift the center of the shoe loading force relative to the shoe. In accordance with the teaching of the publication, the center of shoe loading force can be implemented in two different ways: either by using a movable support assembly adapted mechanically movable relative to the shoe or by using a stationary support assembly by means of which the magnitude of the loading force imposed on the shoe can be hydraulically varied between the leading and trailing edges of the shoe, whereby the center of the loading force is changed relative to the shoe. The arrangements disclosed in the publication are hampered by the complexity of their construction and, hence, high manufacturing costs.

Patent publication U.S. Pat. No. 4,973,384 discloses another prior-art technique of adjusting the nip pressure profile. The embodiment described in the publication has a plurality of grooves made in the cross-machine direction to the underside of the shoe. The upper end of the cylinder loading the shoe has respectively mounted thereon a cross-machine pivot pin aligned in parallel with the grooves of the shoe, whereby the pin can act as a pivotal point for the shoe. Then, the shape of the machine-direction nip pressure profile can be varied by moving the shoe position on the pivot pin of the loading cylinder from one groove to another. A disadvantage of the embodiment disclosed in the publication is that due to the substantially high forces imposed at the pivot point between the shoe of the extended-nip press and its loading cylinder, the spacing between the grooves on the shoe underside must be made relatively wide such that a sufficient portion of shoe material remains on the ridges between the grooves to bear the loading forces imposed thereon. As a result, the control of the nip loading profile takes place in rather coarse steps. Furthermore, the cylinders located underneath the shoe are subject to wear thus needing frequent maintenance.

SUMMARY AND OBJECTS OF THE INVENTION

It is an object of the method and extended-nip press according to the invention to eliminate or at least reduce the above-described problems related to the prior art.

It is a further object of the present invention to provide a method for setting the shoe position in an extended-nip press and, further, an extended-nip press, wherein the shoe position, particularly the tilt angle thereof, can be set and changed at a sufficiently high precision in order to control the nip pressure profile of the extended-nip press. It Is still a further object of the invention to provide an extended-nip press having a simple and reliable function and construction.

It is further another object of the invention to provide an extended-nip press, wherein the shoe and the element loading the same cooperate so that this combination of elements compensates for thermal expansion occurring in an extended-nip press.

To achieve the above-mentioned objects and others, the method for setting the shoe position in an extended-nip press and the extended-nip press according to the invention are principally characterized by what is stated in the characterizing parts of the appended base claims.

The method according to the present invention is characterized in that the shoe element is connected to the loading element by means of a detachable saddle element adapted between the shoe element and the loading element and that the position of the shoe element relative to the loading element is set by adjusting the relative position between the saddle element and the shoe element. In the context of the present text, saddle element refers to a preferredly planar part adapted between the loading element and the shoe element so as to connect the loading element to the shoe element in a functional manner. Loading element in the present context refers to a cylinder or an assembly acting as a loading cylinder such that the shoe element can be pressed at a desired force against a backing roll. The shoe element may comprise a single part or be assembled from a plurality of parts. To set, or change, the position, that is, the angle or alignment of the shoe element in a desired direction, the center of the force imposed by the loading element on the shoe element is changed, whereby also the shape of the nip pressure profile is altered.

In a preferred embodiment of the present invention, the surface of the saddle element facing the loading element and, respectively, the surface of the loading element facing the saddle element are shaped so that these two mating faces form a ball joint. These shaped faces may be implemented so that, e.g., the loading element face is made spherically convex while the saddle element face is made spherically concave or vice versa.

Advantageously, the saddle element and the shoe element are connected to each other by at least one dismountable keyed keyway joint. Key in the present context refers to a key part having a wedged, curved or prismatic shape that connects the saddle element to the shoe element. The key may be a separate element or, alternatively, a structural and integral part of the saddle element or the shoe element. Keyway refers to a wedged, curved or straight-walled slot suited to accommodate the insertion of the key therein for connecting the saddle element to the shoe element. In this context, keyed keyway joint refers to a joint accomplished by inserting the connecting key in the keyway made to the element to be jointed.

Particularly advantageously the surface of the saddle element facing the shoe element and/or the surface of the shoe element facing the saddle element is provided with plural keyways that are located at different distances from the center of the saddle element and of which keyways at least one is utilized for connecting the saddle element to the shoe element. Then, the position of the shoe element relative to the saddle element can be varied by using a different keyway for connecting the elements to each other.

In a preferred embodiment of the method according to the present invention, both the saddle element and the shoe element have on their mating surfaces a keyway, whereby the shoe element can be connected to the saddle element by a detachable key inserted in the keyways provided in the saddle element and the shoe element. Particularly advantageously, the key used for the connection has an asymmetrical shape, whereby the rotation of the key gives a means for changing the mutual disposition of the saddle element and the shoe element that are connected to each other by the key. Eccentricity of the key in this context refers to an asymmetrical cross section of the key relative to its center axis such that the mutual disposition of the saddle element and the shoe element connected to each other by the key can be varied depending on the position of the key.

The extended-nip press according to the present invention is characterized in that the shoe element is connected to its loading element by a detachable saddle element adapted between the shoe element and the loading element.

One of greatest benefits of the method according to the invention is that the position and, as a result, the tilt angle of the shoe can be changed in a rapid and uncomplicated fashion.

The greatest benefit of the extended-nip press according to the invention is its uncomplicated, yet extremely functional construction that can be implemented at a reasonable manufacturing cost, whereby also its maintenance and servicing becomes easy and quick. Furthermore, the construction of the extended-nip press according to the present invention is very durable in use.

An additional benefit of a preferred embodiment of the invention, wherein the saddle element and the loading element form a ball joint, is its good tolerance to thermal expansion by virtue of the joint construction that permits unidirectional tilting of the shoe element. As a result, the entire shoe element can be made from aluminum which is cost-efficient material but has a high thermal expansion coefficient. Due to the good thermal conductivity of aluminum, heat is efficiently transferred to the different parts of the shoe.

A still another benefit of the arrangement according to the invention is that the construction used therein does not need a separate support member for receiving the forces imposed on the shoe. Yet, the present construction may be complemented with limiting member as a safety precaution in malfunction situations in order to prevent the shoe element from slipping away from its normal position. During normal operation of the press, between the shoe and the limiting member remains a gap to prevent the shoe from contacting the limiting member.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DETAILED DESCRIPTION OF THE DRAWINGS

The present invention will become more fully understood from the detailed description given hereinbelow and the accompanying drawings, which are given by way of illustration only, and thus are not limitative of the present invention, and wherein.

DETAILED DESCRIPTION OF THE PREFERRED EMBODIMENTS

Figure 1:
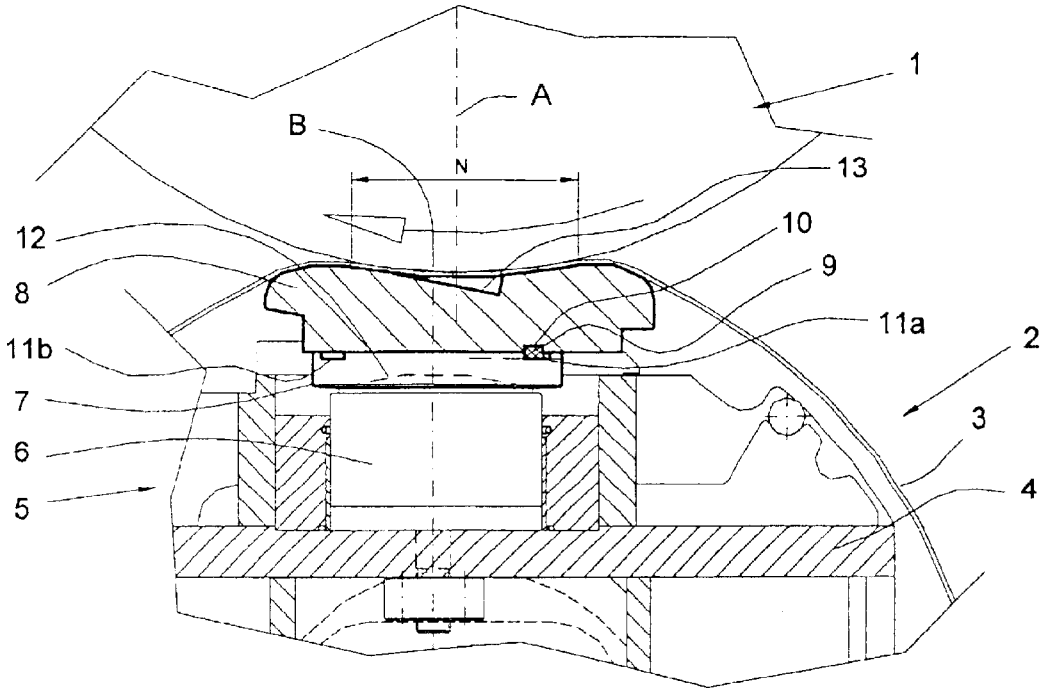
FIG. 1 is a diagrammatic cross-sectional view of an extended-nip press as seen from the end of the press.
Figure 2:
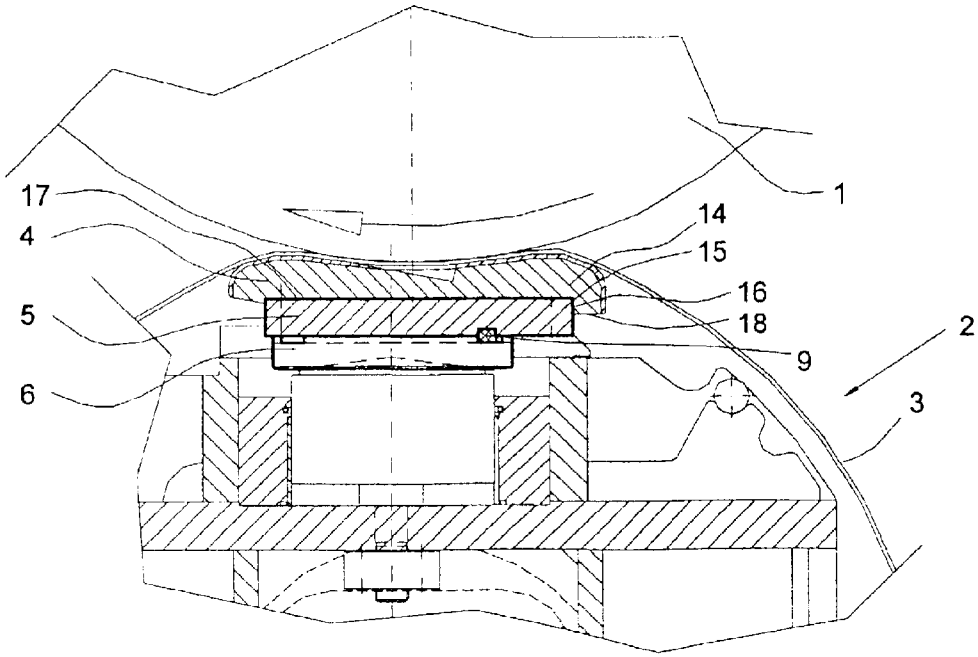
FIG. 2 is a diagrammatic cross-sectional view of an alternative embodiment of an extended-nip press as seen from the end of the press.

In FIGS. 1 and 2 is diagrammatically shown an exemplary embodiment of the construction of an extended-nip press as seen from the end of the press, that is, in a view in the cross-machine direction of the press. The extended-nip press shown therein comprises an upper backing roll 1 and a lower press roll 2 that define therebetween a press zone, later called a press nip N. The backing roll 1 may be a heated roll or an unheated roll. The press roll 2 comprises an endless-loop blanket 3 made from a flexible and liquid-impervious material with a rigid, stationary roll support beam 4 extending axially through the interior of the endless-loop blanket. Furthermore, the press roll 2 comprises loading means 5 that urge the blanket 3 toward the backing roll for forming the above-mentioned nip N in order to remove water from a web passed through the nip. Herein, web refers to a paper or paperboard web. The travel direction of the web passed into the nip is denoted by an arrow in the diagram.

Loading means 5 comprise a loading element 6 connected to a roll support beam 4 and shoe element 8 that is connected to the loading element via a saddle element 7 and is aligned parallel to the center axis of the press roll. The shoe element 8 is connected to the saddle element by a key 9 inserted into both a keyway 10 made on the surface of the shoe element facing the saddle element and a keyway 11*a* made on the surface of the saddle element facing the shoe element. The structure connecting the saddle element to the shoe element is described in more detail later in the text. As drawn in the diagram, the center line A of shoe element 8 which is connected by saddle element 7 to loading element 6 is situated at the center line of backing roll 1, while the center line B of loading element 6 is offset from both of these lines so as to be located to the left from the center line of the backing roll, that is, on the outgoing side of the press zone. As a result, the peak pressure in the nip pressure profile in the basic situation shown in the diagram is located closer to the trailing edge of the press zone.

The loading element 6 is a cylinder which is actuated by a pressurized medium and, in the exemplary embodiment of FIG. 1, comprises a cylinder block with a piston adapted in sealed manner to move in the bore of the cylinder block. The end 12 of the cylinder facing the saddle element is made spherical. Advantageously, the extended-nip press includes a plurality of these loading elements that are placed in a row extending over the entire width of the extended-nip press.

The saddle element 7 is a planar component with its underside, that is, the surface facing the loading element, machined to incorporate a concave recess that after the saddle element is connected to the loading element allows the spherical end surface of the loading element and this concave recess of the saddle element to form a ball joint allowing the shoe element connected to the saddle element to rotate relative to the loading element. The top surface of the saddle element, that is, the surface facing the shoe element is provided with keyways of which in the diagram are shown two denoted by reference numerals 11*a* and 11*b*. The saddle element keyways and their location are discussed in more detail later in the text.

The shoe element 8 shown in FIG. 1 is made from a suitable metal such as aluminum. The top surface of the shoe element opposed to the backing roll has a concave cross section forming a pressure pocket 13. As shown in the diagram, the pressure pocket is generally of the hydrodynamic type. Alternatively, a hydrostatic pressure pocket may be used, whereby the shoe element would additionally comprise at least one line connection for feeding cooling/lubricating oil into the pressure pocket. When the shoe element is pressed against the backing roll, the endless-loop blanket assumes a shape that is determined by the concave face of the shoe element and the curvature of the backing roll adapted to cooperate with the press roll, whereby the blanket together with the backing roll defines a press zone through which the paper or paperboard web is passed to remove water from the web.

FIG. 2 shows an alternative embodiment of an extended-nip press. The construction shown in the diagram is otherwise identical to that of FIG. 1 with the exception that shoe element 8 herein comprises two parts: a topmost shoe plate 14 adapted to face the blanket and a pressure plate 15 connected to the saddle element. The shoe plate and the pressure plate can be made from the same material, e.g., from aluminum. The plates may also be of different materials, e.g., so that the shoe element is of aluminum while the pressure plate is of steel. The shoe plate and the pressure plate are joined to each other by an interface 16 comprising a recess 17 on the underside of the shoe plate and a projection 18 at the ingoing side of the press.

In addition to those described above, an extended-nip press includes other parts and elements omitted from the diagrams for greater clarity. These means are, e.g., means for feeding coolant and lubricant onto the top surface of the shoe, means for feeding pressurized medium into the cylinder acting as the loading element, etc. Furthermore, an extended-nip press may be implemented in an inverted fashion, whereby the press roll is located above the backing roll.

Figure 3:
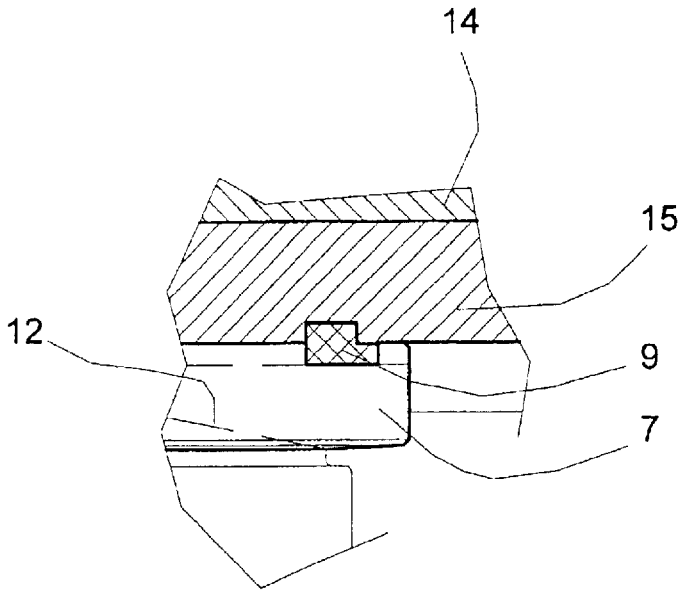
FIG. 3 is an enlarged view illustrating the connection between the saddle element and the shoe element.

FIG. 3 shows a partially sectional enlarged view of the components of FIG. 2 as to the connection of the shoe formed by the shoe plate 14 and the pressure plate 15 to the saddle element 8 by means of a key 9 fitted into keyways 10 and 11 of the mated components. As drawn in FIG. 3, the key may have an eccentric shape by being asymmetrical about the vertical center axis of its cross section such that the key is wider by its portion insertable into the keyway 11 of the saddle element than by its portion insertable in the keyway 10 of the shoe element, whereby the key has a substantially L-shaped cross section. As a result, 180° rotation of the key allows the mutual disposition between the shoe element and the saddle element to be changed by a given distance which is equal to the difference of widths across the above-mentioned top and underside surfaces of the key. For instance, if the top surface of the key is made 1 mm narrower than the underside of the key, rotation of the key upside down makes a 1 mm change in position of the shoe element relative to the saddle element. Now, inasmuch the position of the saddle element relative to the loading element has remained unchanged, the shoe element has been moved by the above-mentioned distance relative to the loading element. By these actions, the center point of the force imposed by the loading element on the shoe element is moved to another point of the shoe element thus tending to rotate the shoe element that subsequently rotates supported by the ball joint formed between the shoe element and the saddle element. As a consequence, the location of the press zone and/or the nip pressure profile thereof is modified by the rotation of the shoe element.

Figure 4:
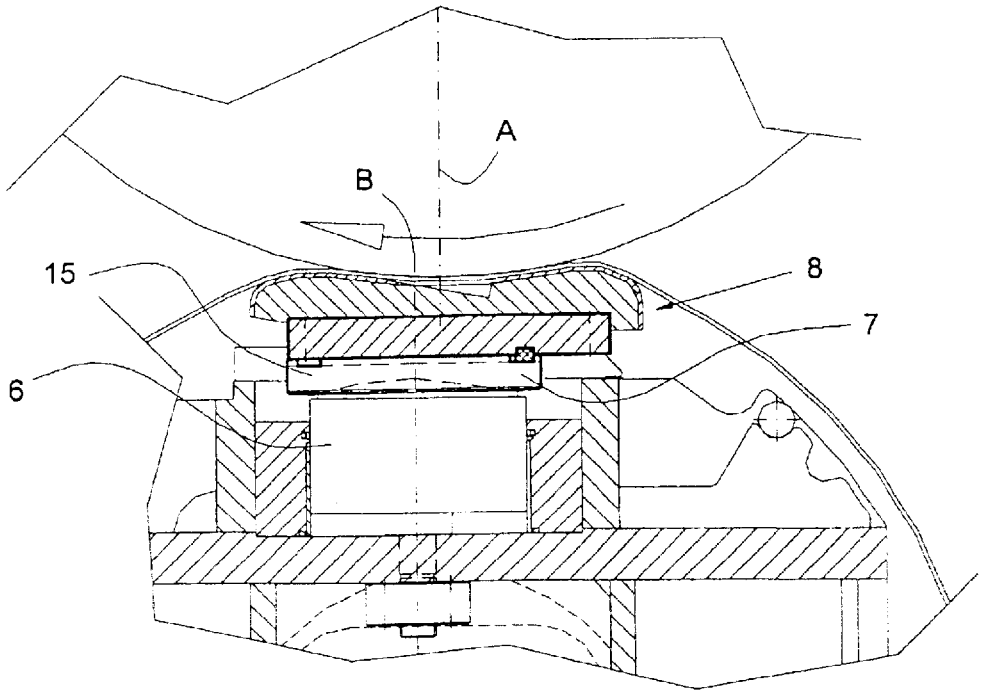
FIG. 4 is a cross-sectional view illustrating the extended-nip press of FIG. 2 adjusted to another operating position.

FIG. 4 shows the extended-nip press of FIG. 2 now illustrating the effect of the rotation of the above-described key element on the position of the shoe element 8 relative to the saddle element 7 and the loading element 6. As compared with the operating position illustrated in FIG. 2, the shoe element is herein shifted in the direction of the ingoing side of the press zone, that is, to the right as is evident, e.g., by examining the position of the left-side edge of the shoe element pressure plate 15 that has been shifted from the position of FIG. 2 to a new position flush with the left-side edge of saddle element 7. Due to the shift in the shoe element position, center point A of the shoe element has moved farther away from center point B of the loading element, whereby the center point of the force imposed by loading element on the shoe element has respectively shifted closer to the outgoing side of the press zone resulting in a change of the nip pressure profile in the press zone such that pressure peak is located closer to the outgoing side of the press.

Figure 5:
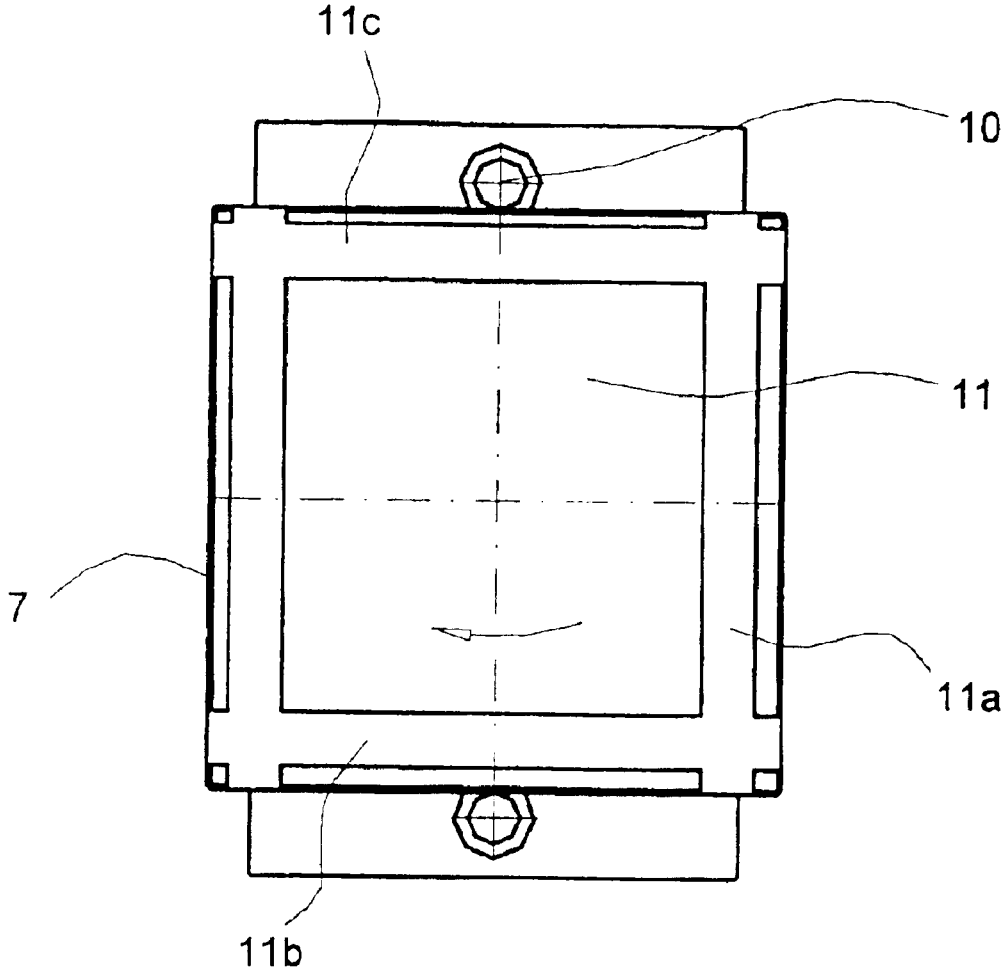
FIG. 5 is a diagrammatic top view of the saddle element.

FIG. 5 shows the saddle element 7 in a top view, that is, from the side facing the shoe element. To the top surface of the saddle element are machined keyways 11*a*, 11*b*, 11*c* and 11*d*. The keyways are located at different distances from the center point of the saddle element. Otherwise the saddle element is symmetrical about the vertical center axis of its cross section. By placing the keyways at different distances from the center point of the saddle element, the position of the shoe element connected by the key to the saddle element can be changed relative to the center point of the saddle element and, thus, relative to the loading element. Resultingly, rotation of the saddle element gives four alternative positions for the shoe element.

In the exemplary embodiments shown in the diagrams, the shoe element is in its basic position in FIG. 1. Herein, the locations of the keyways made on the saddle element are shifted by 2 mm relative to each other, and the asymmetry of the key expressed as the width difference between its top surface and underside surface is 8 mm. With these design parameter values, the position of the shoe element can be changed from its basic position so that the press shoe may be moved from its basic position maximally 2 mm to the left, that is, toward the outgoing side of the press zone and maximally 12 mm toward the incoming side. Having the key in its basic position, rotation of the saddle element gives the shoe element four different positions: normal position, −2 mm, +2 mm and +4 mm. If the key is rotated upside down, the shoe element is moved 8 mm toward the incoming side, whereby rotation of the saddle element gives the shoe element respectively the following four positions: +8 mm, +6 mm, +10 mm and +12 mm.

It must be understood that the invention is not limited by the exemplary embodiment described above, but rather may be varied within the inventive spirit and scope of the appended claims. For instance, the location of the keyways may be shifted differently in varying applications. Furthermore, the location of the keyways may be modified, e.g., so that the keyways are located successively on the saddle element or, alternatively, the selectable keyways may be made on the shoe element. Moreover, the connection of the loading element to the saddle element could be implemented without using a detachable and asymmetric key, whereby key must be made into an integral portion of either one of the elements to be connected to each other.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A method for setting the position of the shoe in an extended-nip press having a press roll and a backing roll, said press roll comprising:

a rotating endless-loop blanket made of a flexible, liquid-impervious material, a rigid and advantageously stationary roll support beam that extends axially through an interior of the endless blanket, at least one shoe element mounted between the roll support beam and the interior of the endless blanket, the at least one shoe element having a concave top surface, and a loading element for loading the shoe element by pressing the concave top face thereof against the flexible endless-loop blanket so as to make the blanket form a press nip zone in cooperation with the backing roll, the method comprising the steps of:

connecting the shoe element to the loading element by a detachable saddle element mountable between the shoe element and the loading element;

connecting the saddle element and the shoe element to each other by at least one dismountable keyed keyway joint; and setting the position of the shoe element relative to the loading element by changing a mutual disposition of the saddle element and the shoe element.

2. The method of claim 1, further comprising the step of:

shaping a surface of the saddle element facing the loading element, and shaping a surface of the loading element facing the saddle element so that the two mating faces form a ball joint.

3. The method of claim 1, characterized in that further comprising the step of:

providing a surface of the saddle element facing the shoe element with a plurality of first keyways located at different distances from the center point of the saddle element, and connecting the saddle element to the shoe element by at least one of the first keyways.

4. The method of claim 1, further comprising the step of:

providing a surface of the saddle element facing the shoe element with plural second keyways located at different distances from the center of the shoe element, and connecting the shoe element to the saddle element by at least one of the second keyways.

5. The method of claim 3, further comprising the step of:

changing the mutual disposition between the shoe element and the saddle element by substituting one of the first keyways for another of the first keyways.

6. The method of claim 1, characterized in that further comprising the step of:

connecting together at least one of the first or the second keyways provided on opposed sides of both the shoe element and the saddle element, and connecting the shoe element to the saddle element by inserting a key into the at least one keyway of the saddle element and the shoe element.

7. The method of claim 6, further comprising the step of:

rotating the key (9) in order to change the mutual disposition between the shoe element and the saddle element connected together by the key, the key having an asymmetrical cross section.

8. An extended-nip press comprising a press roll and a backing roll, said press roll comprising:

a rotating endless-loop blanket made of a flexible, liquid-impervious material, a rigid and advantageously stationary roll support beam extends axially through an interior of the endless blanket, at least one shoe element mounted between the roll support beam and the endless-loop blanket, the at least one shoe element having a concave top face, and a loading element for loading the shoe element by pressing the concave top face thereof against the flexible endless-loop blanket so as to make the blanket form a press nip zone in cooperation with the backing roll, wherein the shoe element is connected to the loading element by a detachable saddle element mountable between the shoe element and the loading element, and the saddle element and the shoe element are connected to each other by at least one dismountable keyed keyway joint.

9. The extended-nip press of claim 2, wherein the saddle element and the loading element function as a ball joint when fitted together.

10. The extended-nip press of claim 8, wherein a surface of the saddle element facing the shoe element is provided with a plurality of first keyways located at different distances from a center of the saddle element.

11. The extended-nip press of claim 8, wherein a surface of the shoe element facing the saddle element is provided with plural second keyways located at different distances from a center of the shoe element.

12. The extended-nip press of claim 8, wherein both the saddle element and the shoe element are provided with a plurality of first keyways and a second keyway and the saddle element and the shoe element are connected to each other by at least one detachable key insertable into one of said first keyways of said second keyway.

13. The extended-nip press of claim 12, wherein the key has an asymmetric cross section that is wider on one side than on an opposite side, such that the key has a substantially L-shaped cross section.

14. The method of claim 4, further comprising the step of:

changing the mutual disposition between the shoe element and the saddle element by substituting one of the second keyways for another one of the second keyways.

* * * * *